US007794362B2

(12) United States Patent
Miller

(10) Patent No.: US 7,794,362 B2
(45) Date of Patent: Sep. 14, 2010

(54) EXERCISE DEVICE WITH ADJUSTABLE STRIDE

(75) Inventor: Larry D. Miller, Rochester, MI (US)

(73) Assignee: Larry D. Miller Trust, Rochester Hills, MI (US)

( * ) Notice: Subject to any disclaimer, the term of this patent is extended or adjusted under 35 U.S.C. 154(b) by 48 days.

(21) Appl. No.: 12/051,214

(22) Filed: Mar. 19, 2008

(65) Prior Publication Data

US 2009/0105049 A1 Apr. 23, 2009

Related U.S. Application Data

(60) Provisional application No. 60/981,217, filed on Oct. 19, 2007.

(51) Int. Cl.
*A63B 22/04* (2006.01)

(52) U.S. Cl. ..... 482/52; 482/70

(58) Field of Classification Search ..... 482/51, 482/52, 57, 60, 62, 70, 71, 110, 53, 110.148, 482/908; 601/27, 29, 34, 35, 36; 434/247, 434/255

See application file for complete search history.

(56) References Cited

U.S. PATENT DOCUMENTS 5,383,829 A 1/1995 Miller
5,788,610 A * 8/1998 Eschenbach ..... 482/52
6,024,676 A * 2/2000 Eschenbach ..... 482/51
6,045,487 A * 4/2000 Miller ..... 482/52
6,390,953 B1 * 5/2002 Maresh et al. ..... 482/52
6,461,277 B2 * 10/2002 Maresh et al. ..... 482/52
7,132,531 B1 11/2006 Wellings et al.
7,169,088 B2 1/2007 Rodgers, Jr.
7,169,089 B2 1/2007 Rodgers, Jr.
7,172,531 B2 2/2007 Rodgers, Jr.
7,179,201 B2 2/2007 Rodgers, Jr.
7,201,705 B2 4/2007 Rodgers, Jr.
7,214,168 B2 5/2007 Rodgers, Jr.
7,244,217 B2 7/2007 Rodgers, Jr.
7,244,218 B1 7/2007 Lin et al.
7,316,632 B2 1/2008 Rodgers, Jr.
7,520,839 B2 4/2009 Rodgers, Jr.
7,530,926 B2 5/2009 Rodgers, Jr.
7,556,591 B2 * 7/2009 Chuang et al. ..... 482/52
2004/0248709 A1 12/2004 Rodgers
2007/0087906 A1 4/2007 Rodgers
2007/0087907 A1 4/2007 Rodgers (Continued)

OTHER PUBLICATIONS

Brochure "Adaptive Motion Trainer" Precor Corporation, Sep. 30, 2007.

*Primary Examiner*—Loan Thanh
*Assistant Examiner*—Tam Nguyen
(74) *Attorney, Agent, or Firm*—Gifford, Krass, Sprinkle, Anderson & Citkowski, P.C.

(57) ABSTRACT

An exercise device providing a running and stepping foot action is configured to have an adjustable stride length which may be varied and reconfigured by a user while the device is in operation. The device effectively decouples the horizontal and vertical paths of travel of a user's foot. In this regard, the device includes a foot link which moves in a substantially horizontal path of travel under the control of a reciprocating link which engages a portion of the foot link. A control link engages another portion of the foot link and moves it in a substantially vertical direction under control of a crank assembly.

7 Claims, 7 Drawing Sheets

U.S. PATENT DOCUMENTS

2007/0219061 A1 9/2007 Rodgers, Jr.
2007/0219062 A1 9/2007 Rodgers
2009/0156369 A1* 6/2009 Rodgers, Jr. ..... 482/52

* cited by examiner

EXERCISE DEVICE WITH ADJUSTABLE STRIDE

CROSS-REFERENCE TO RELATED APPLICATIONS

This application claims priority of U.S. Provisional Patent Application Ser. No. 60/981,217 filed Oct. 19, 2007, entitled "Exercise Device with Adjustable Stride" which is incorporated herein by reference.

FIELD OF THE INVENTION

This invention relates generally to exercise equipment. More specifically the invention relates to exercise equipment which provides a natural running and stepping motion. In particular, the invention relates to an exercise device providing a natural running and stepping motion wherein the action of the device adaptively adjusts to a user's changing stride.

BACKGROUND OF THE INVENTION

Many different types of exercise device have been implemented in the prior art. Such devices operate to simulate various athletic activities such as rowing, cross-country skiing, stair climbing and the like. One particular class of exercise devices which have been found to have significant benefit comprise those devices which simulate a natural combined running and stepping action wherein a user's foot follows a path of resistance having both horizontal and vertical components. One notable class of such devices comprise those known as elliptical devices, as typified by the device disclosed in U.S. Pat. No. 5,383,829.

While exercise devices which simulate a running and stepping foot motion are in very widespread use, many such devices provide a single, fixed, foot path. In some instances, a user of the device may wish to modify the foot action to accommodate a longer or shorter stride length and/or vary the vertical component of the foot motion. Such modifications may be accomplished by changing the geometric configuration of the linkages constituting the device. However, such modifications cannot easily be accomplished when the device is in use; therefore, such systems cannot allow for in-motion modification of the foot path as is desired by many users. The prior art has implemented a great number of systems which attempt to modify the foot action of an elliptical trainer or other such running/stepping exercise device. Some of these prior art approaches are disclosed in U.S. Pat. Nos. 7,244,218; 7,201,705; 7,172,531; 7,316,632; 7,179,201; 7,169,089; and 7,214,168; as well as in pending published applications US 2007/0087907 and US 2007/0087906.

However, to date, there is still a need for a running/stepping type exercise device in which the horizontal and vertical components of the foot motion may be continuously modified while the device is in use. Any such systems should be relatively simple in construction, low in cost and easy to use. As will be explained in detail hereinbelow, the present invention provides a running/stepping exercise device, including elliptical devices, in which a user's foot path may be varied while the device is in use. The system of the present invention is simple, easy to use and easy to implement. These and other advantages will be apparent from the drawings, discussion and description which follow.

BRIEF DESCRIPTION OF THE INVENTION

Disclosed herein is an exercise device operable to provide an adjustable stride. The device includes a frame having a first, a second and a third pivot point defined thereupon at mutually spaced apart locations. The device further includes a crank assembly including a first crank arm. The crank assembly is pivotally supported on the frame at the first pivot point so that the first crank arm is rotatable thereabout. The device includes a first and a second reciprocating link. Each is pivotally supported on the frame at the second pivot point so that a first end of each can move in a reciprocal path relative to the frame. The device includes a first and a second foot link each of which is in mechanical communication with a respective reciprocating link through a pivot point on the foot link which is spaced from either end of the foot link. The device also includes a first and a second swing arm. Each swing arm is pivotally supported on the frame at the third pivot point so that a first end of each pivot arm can move in a reciprocal path of travel relative to the frame. The swing arms are in mechanical communication with the crank assembly so that when the first crank arm rotates about the first pivot axis, the crank assembly causes the first ends of the swing arms to move in a reciprocal path. The device also includes a first and a second control link. Each control link is connected to a respective foot link and to a respective swing arm so that when the first end of each swing arm travels in its reciprocal path, its respective control link moves in a reciprocating path of travel and thereby raises and lowers a portion of the foot link. In this manner, the reciprocating links provide for motion of the foot links along a first, generally horizontal path of travel and the control links provide for motion of the foot links along a generally vertical path of travel, wherein the horizontal path of travel and the vertical path of travel are mechanically independent of one another.

In some embodiments, the crank assembly includes a second crank arm which is rotatable about the first pivot point. In this embodiment, the first swing arm is in mechanical communication with the first crank arm via a first connecting link and the second swing arm is in mechanical communication with the second crank arm via a second connecting link.

In yet other embodiments, the first and the second swing arm comprise portions of a single unitary, elongated member which is pivotally supported on the frame at the second pivot point. In this embodiment, the first crank arm may be connected to the unitary, elongated member through a connecting link and in this manner operate to move both swing arms.

In certain embodiments, the device is configured so that a connection point at which each swing arm is connected to its respective control link travels along a path of travel from a first limit to a second limit and wherein as each reciprocating link moves in its reciprocal path of travel the end thereof defines an angle relative to the point at which the reciprocating link is pivotally supported on the frame, and wherein the apparatus is configured so that a line extending between the first and second limits of travel of a swing arm is parallel to the bisector of the angle formed by the travel of the reciprocating link.

In some embodiments, the connection points between the various members constituting the device may be made adjustable so that the configuration of the device may be varied.

In some embodiments, the reciprocating links may be mechanically coupled together so as to move in synchrony.

DETAILED DESCRIPTION OF THE INVENTION

The present invention concerns an exercise device of the running/stepping type in which a user may adjust the parameters of foot motion while the device is in use. In this regard, the device of the present invention adapts to, and follows, a user's foot motion while providing support and a smooth even resistance. As such, the present invention provides exercise devices which can accommodate users of different sizes and athletic ability. Furthermore, the devices in accord with the present invention allow a user to vary the ratio of vertical and horizontal components of the foot motion continuously, and independently, throughout a workout. For example, a user employing a device in accord with the present invention can start a workout with a relatively short, flat stride and then progress to an elongated stride without stopping. Likewise, the vertical component of the motion may be varied; and in this manner, an exercise program covering a very large range of motion is readily implemented. In addition to the foregoing, the device of the present invention is configured to have a simplified structure, as compared to prior art devices, so that a user can easily mount and dismount from the device.

Presented herein are some specific embodiments of devices in accord with the present invention. In view of the teaching of the general principles of the invention and the illustration of these specific embodiments, other modifications and variations will be apparent to those of skill in the art.

Figure 1:
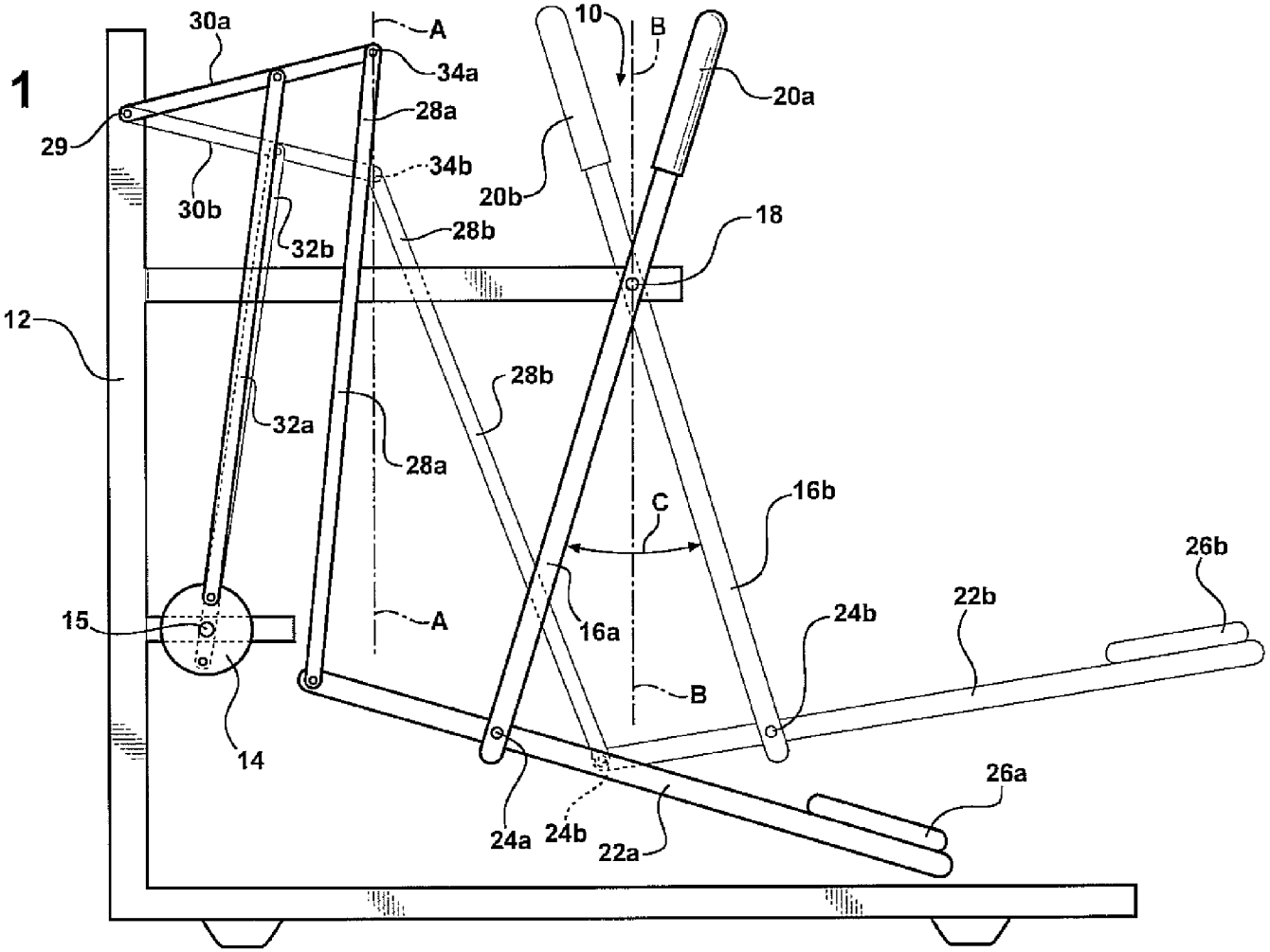
FIG. 1 is a depiction of one embodiment of exercise device in accord with the present invention.

Referring now to FIG. 1, there is shown one embodiment of exercise device 10 structured in accord with the principles of the present invention. The device 10 of FIG. 1 includes a frame 12 which is configured to support the various mechanical elements of the device. As illustrated, the frame 12 is specifically configured to rest on a subjacent surface such as a floor; however, it is to be understood that the frame may be alternatively configured so as to support the device on a wall or from an overhead structure. The device 10 of FIG. 1 includes a first and a second crank arm which are part of a crank assembly 14 that is pivotally supported on the frame at a first pivot point 15. In this instance the crank assembly is constituted by a flywheel 14, which also constitutes crank arms as will be explained. In the FIG. 1 illustration, only a first crank arm is shown, and in this instance, it is defined by a portion of the flywheel 14 pivotally supported at the first pivot point on a projecting portion of the frame 12. It is to be understood that in other instances, other arrangements of crank assembly may be employed. For example, the crank assembly may include a crank arm which is a separate element from the flywheel and may be coupled thereto by a drive belt or the like. In yet other instances, the flywheel may be dispensed with completely.

The device 10 of FIG. 1 further includes a first and a second reciprocating link 16*a*, 16*b* pivotally supported on the frame 12 at a second pivot point 18 so that first ends of each reciprocating link 16 can move in a reciprocal path of travel relative to the frame. As illustrated, the reciprocating link 16 includes projecting handgrip portions 20*a*, 20*b*. In some instances, these handgrip portions may be otherwise configured. For example, they may be curved or bent or otherwise displaced from the axis of the reciprocating link 16. In yet other instances, the handgrip portions may be eliminated.

The device includes a first and a second foot link, each of which is in mechanical communication with a respective reciprocating link through a pivot point on the foot link which is spaced from either end of the foot link. In the illustrated embodiment, a first foot link 22*a* is pivotally affixed to the first reciprocating link through pivot point 24*a*. Likewise, a second foot link 22*b* is affixed to the second reciprocating link 16*b* through pivot point 24*b* (shown in phantom outline). As illustrated in FIG. 1, each of the foot links 22 includes a corresponding foot-engaging portion 26*a*, 26*b*. In the illustration, the foot-engaging portions 26 are disposed at a second end of the foot links 22; however, it is to be understood that in other instances they may be otherwise placed or eliminated. Also, while the foot links are shown as being straight, unitary members, it is to be understood that they may be curved members, articulated members, or otherwise configured.

The exercise device 10 further includes a first control link 28*a* and a second control link 28*b*. Each of the control links 28 is connected to a respective foot link 22, and each control link 28 is also in mechanical communication with a respective crank arm. In the instance of the FIG. 1 embodiment, the control links 28 communicate with the crank assembly via a coupling assembly which comprises a swing arm 30 which in turn engages connecting links 32 which connects the swing arm 30 to the crank arm. As is specifically illustrated in FIG. 1, control link 28*a* engages foot link 22*a* and further engages a first swing arm 30*a* which is pivotally supported on the frame 12 at a third pivot point 29. The swing arm 30*a* is coupled to the crank arm portion of the flywheel of the crank assembly 14 by the connecting link 32*a*. As the crank arm rotates, the connecting link 32*a* raises and lowers the swing arm 30*a* which in turn raises and lowers the control link 28*a* and hence raises and lowers the end of the foot link 22*a* thereby moving a user's foot disposed thereupon along a path having a vertical component of motion. A similar motion is achieved in the second foot link 22*b* by corresponding links and members.

In the illustrated embodiment, the reciprocating links 16 provide for motion of the foot link along a first path of travel having a significant horizontal component and the control link, as activated by the crank arm and associated coupling assembly, provides for motion of the foot link along a path of travel having a large, generally vertical component. As is to be understood, the terms "horizontal" and "vertical" are used in a relative sense to indicate two separate axes of motion, disposed in an angular relationship. And, depending on the positioning and configuration of the apparatus, the "horizontal" component may not be parallel to the floor, ground or other surface proximate the foot links. Likewise, the "vertical" component may not be in a right angled relationship with such surface. The motion of the reciprocating links and the motion of the control links are mechanically independent of one another and hence the vertical and horizontal components of the foot motion achieved through the use of the exercise device are substantially independent of one another. This arrangement allows the motion of the device to adapt to a user's needs and wants.

The drawing of FIG. 1 is marked so as to illustrate a particular geometric relationship between certain components of the device as configured in particular embodiments of the invention. As shown, the crank arms associated with the flywheel assembly 14, and connecting links 32 move the swing arms 30 through a range of motion having predetermined upper and lower limits, and as shown, the swing arm 30*a* is at its upper limit of motion and the swing arm 30*b* is at its lower limit of motion. As further shown in FIG. 1 dotted line A-A passes through the point 34*a*, 34*b* at which the swing arms are connected to their respective control links. As further shown, the reciprocating links 16*a*, 16*b* swing about the second pivot point 18 on the frame 12 and in so doing define an angle C, and as is shown in FIG. 1, dotted line B-B is the bisector of this angle.

In this particularly configured embodiment, line A-A and B-B are substantially parallel. It has been found that configuring the exercise device so that this geometric relationship is attained effectively decouples the vertical and horizontal components of the motion of the foot links, and allows for the smooth and efficient functioning of the device through a large range of motions. It is to be understood that owing to some resilience in the materials used to manufacture the device, and various tolerances at the pivot points, some deviation from this absolutely parallel relationship may be tolerated while still securing the benefits of this particular embodiment.

In the FIG. 1 embodiment and the FIG. 2 illustration, the foot link is shown as being directly connected to the reciprocating link. However, in other embodiments, such need not be the case. For example, a more complex linkage including one or more guides or other elements may be used to join the foot link to the reciprocating link.

Yet other modifications of the foregoing apparatus may be employed. For example, the crank arm assembly may have a variable resistance device such as a magnetic device, frictional device, or other such device associated therewith to control the action of the system. Likewise, or alternatively, the motion of the reciprocating link 16 may incorporate a variable resistance device in association therewith. Also, ramps, guides and the like may be incorporated into the apparatus as is known in the art.

In the FIG. 1 embodiment (and in the other illustrated embodiments), the connection points between the various links and other elements are shown as being at permanently fixed locations. It is to be understood that these connection points may be made adjustable. For example, the links may include a series of holes along a portion of their length, and these holes may be used in combination with a pivot pin to variously connect the links. Alternatively, or additionally, the lengths of the links themselves may be made adjustable, through the use of telescoping segments or the like. Incorporation of such features will allow for the modification and adjustment of the action achieved by the exercise device. For example, by varying the length of the crank arm, or by varying the connection point between the swing arm and the control link, the vertical component of the motion can be lengthened or shortened. Other adjustments may likewise be made. In some instances, the apparatus may be configured so that the adjustments can be made while the apparatus is in use.

Figure 2B:
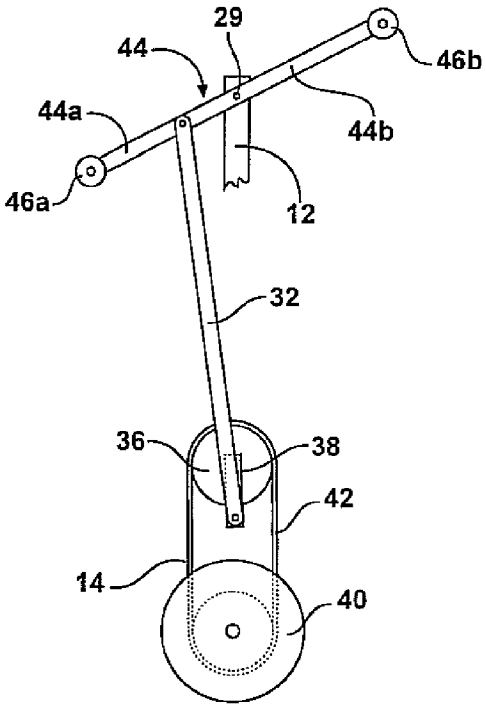
FIG. 2B is an end view of a portion of the device of FIG. 2A better illustrating the swing arm, crank and connecting link.
Figure 2A:
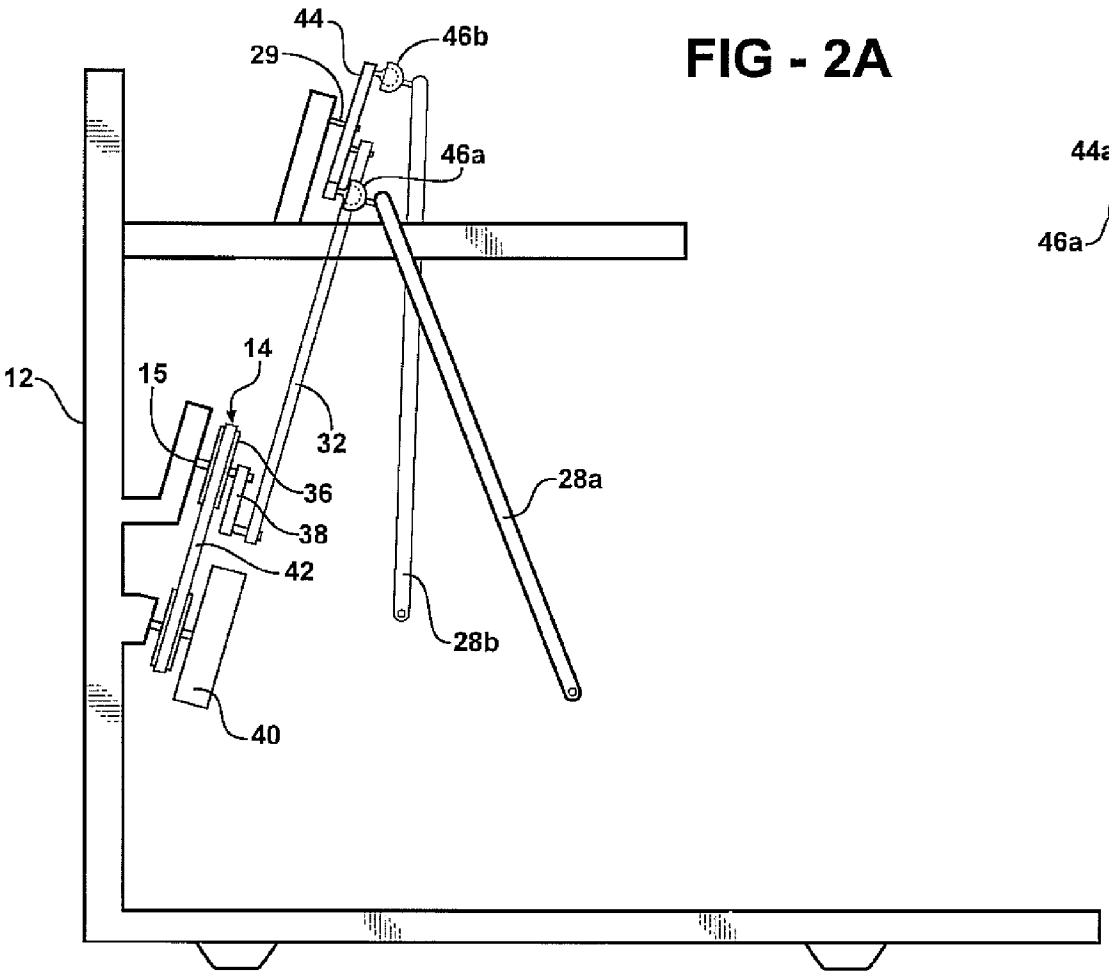
FIG. 2A is a side view of another embodiment of exercise device structured in accord with the present invention.

Referring now to FIGS. 2A and 2B, there is shown another embodiment of exercise device in the present invention specifically including a combination of crank assembly and swing arms which differ from those of the FIG. 1 embodiment. FIG. 2A is a side elevation view of the apparatus, and for purposes of simplifying the drawing, the reciprocating links and foot links shown in FIG. 1 have been left out of this illustration; however, it is to be understood that they are generally similar to those previously described and illustrated. The FIG. 2A embodiment includes a frame 12 which is generally similar to that previously described. The apparatus includes a crank assembly 14 pivotally supported on the frame 12 at a first pivot point 15. In the FIG. 2A illustration, the crank assembly 14 includes a first pulley 36 pivotally supported at the first pivot point 15. The crank assembly includes a single crank arm 38 also pivotally supported at the first pivot point 15. As further illustrated, the crank assembly 14 includes a flywheel 40 which is coupled to the first pulley 36 by a drive belt 42. It is to be understood that this flywheel 40 may be eliminated, or may be disposed so as to replace the first pulley 36. As is to be further understood, the flywheel 40 may have a braking device such as a frictional brake, magnetic brake, aerodynamic brake or the like associated therewith to allow for control of the resistance of the exercise device.

Referring now to FIG. 2B, there is shown an end view of a portion of the device of FIG. 2A better illustrating the connection and operation of the crank assembly and swing arms. As will be seen from FIG. 2B, a single, unitary, elongated member 44 is pivotally connected to the frame 12 at the second pivot point 29. This elongated member 44 constitutes the first and the second swing arms so that the first swing arm is constituted by a first portion of the elongated member 44 portion 44*a*), and the second swing arm is constituted by the second portion 44*b* of the elongated member 44. As mentioned above, the crank assembly 14 includes only a single crank arm 38 which rotates about the first pivot axis (15 in FIG. 2A). This crank arm 38 is coupled to the elongated swing arm member 44 via a connecting link 32. Because the swing arms are constituted by a single member, a single crank and connecting link will reciprocate both swing arms. As will be further seen from FIGS. 2A and 2B, the swing arms include ball joint connectors 46*a*, 46*b* respectively which couple the swing arms to the respective control links 28*a*, 28*b* which engage the foot links (not shown).

The device of FIGS. 2A and 2B may be configured, as described with reference to FIG. 1, so that a line extending between the limits of travel of the first end of either of the swing arms 44*a*, 44*b* will be parallel to the bisector of the angle defined by the travel of the swing arms 28*a*, 28*b*.

Figure 3A:
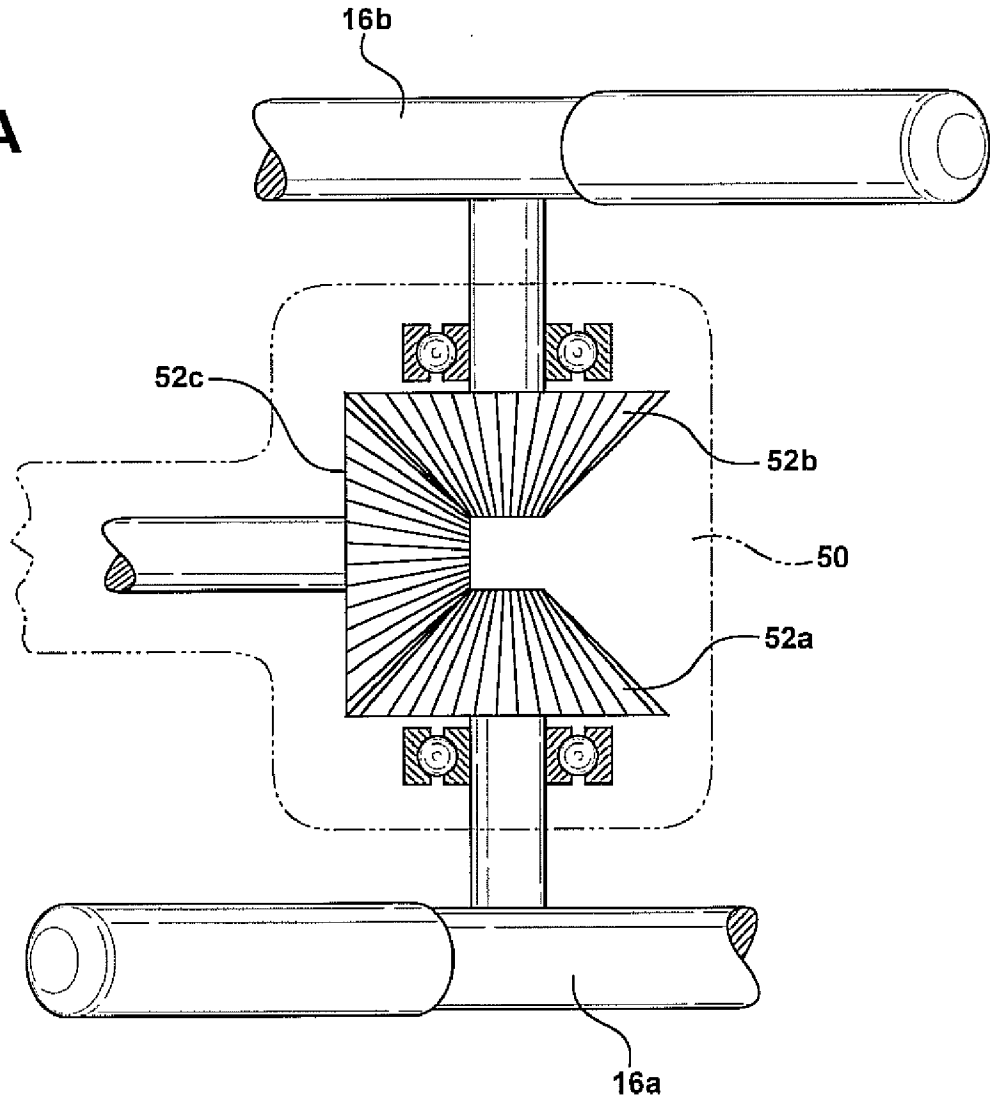
FIGS. 3A and 3B are depictions of a synchronizer gear arrangement which may be utilized to coordinate the motions of the reciprocal links in the present invention.
Figure 3B:
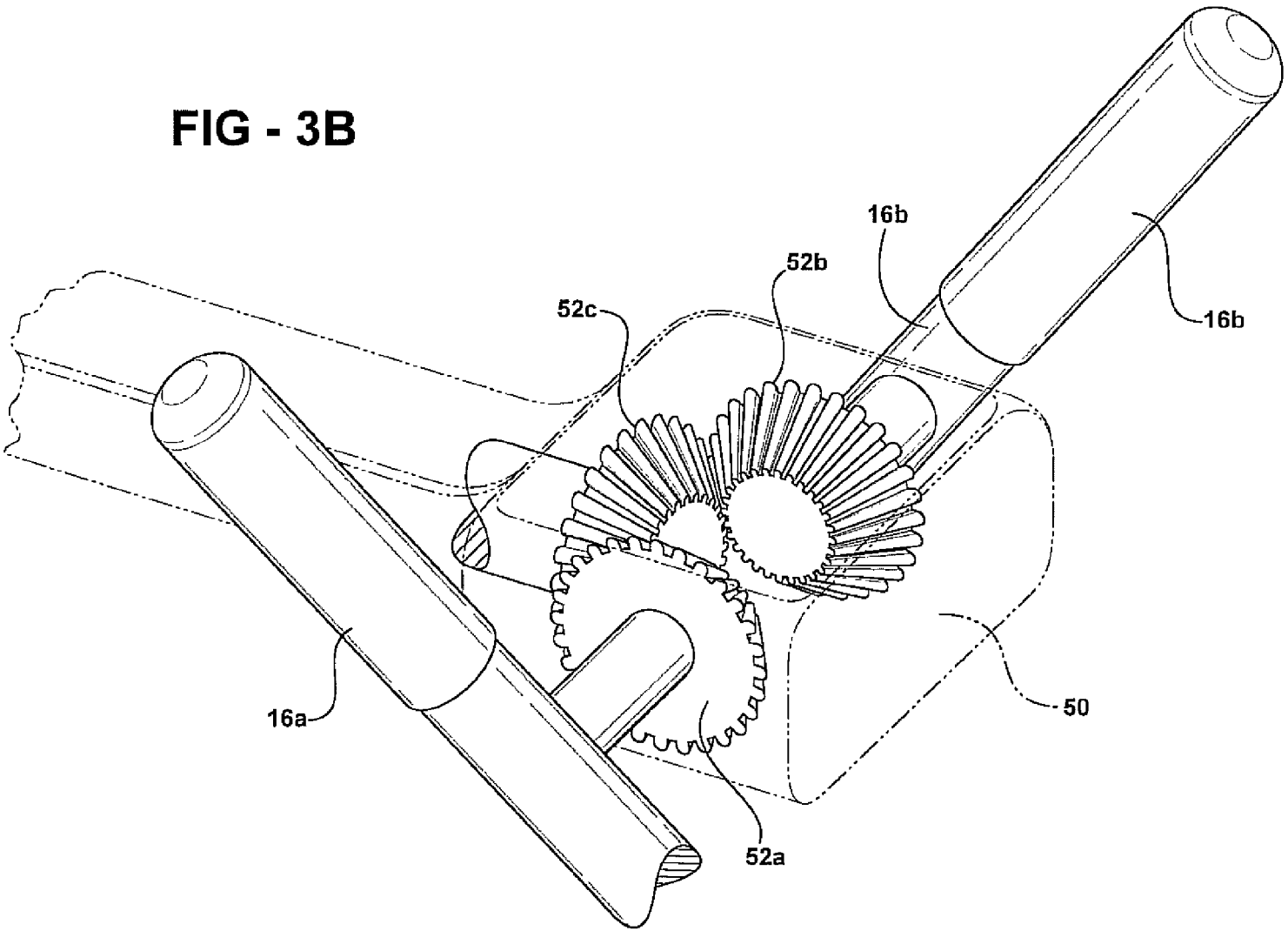

In the embodiments of FIG. 1 and FIGS. 2A and 2B, the reciprocal motion of the two reciprocating links is completely independent. In some instances, users may find it more desirable to have the two reciprocating links moving synchronously, and such may be accomplished by various mechanical, electrical and electromechanical synchronization systems. Referring now to FIGS. 3A and 3B, there is shown one such mechanical system. FIG. 3A is a top plan view, partially cut away, of a gearing arrangement for assuring that reciprocating links 16*a*, 16*b* move in synchrony, and in opposition directions. As shown in FIG. 3A, the mechanical system includes a gearbox 50, shown in phantom outline and including a set of bevel gears 52*a*, 52*b*, 52*c* therein. As shown, reciprocating link 16*a* is pivotally supported on a shaft which supports bevel gear 52*a*. Similarly, reciprocating link 16*b* is supported on a shaft which engages bevel gear 52*b*. The two gears are in communication via a third bevel gear 52*c*. This gearing arrangement will assure that the desired synchronous motion will be achieved. FIG. 3B is a perspective view of the same gearing arrangement. It is to be understood that various other modifications and variations will be readily apparent to those of skill in the art.

Figure 4A:
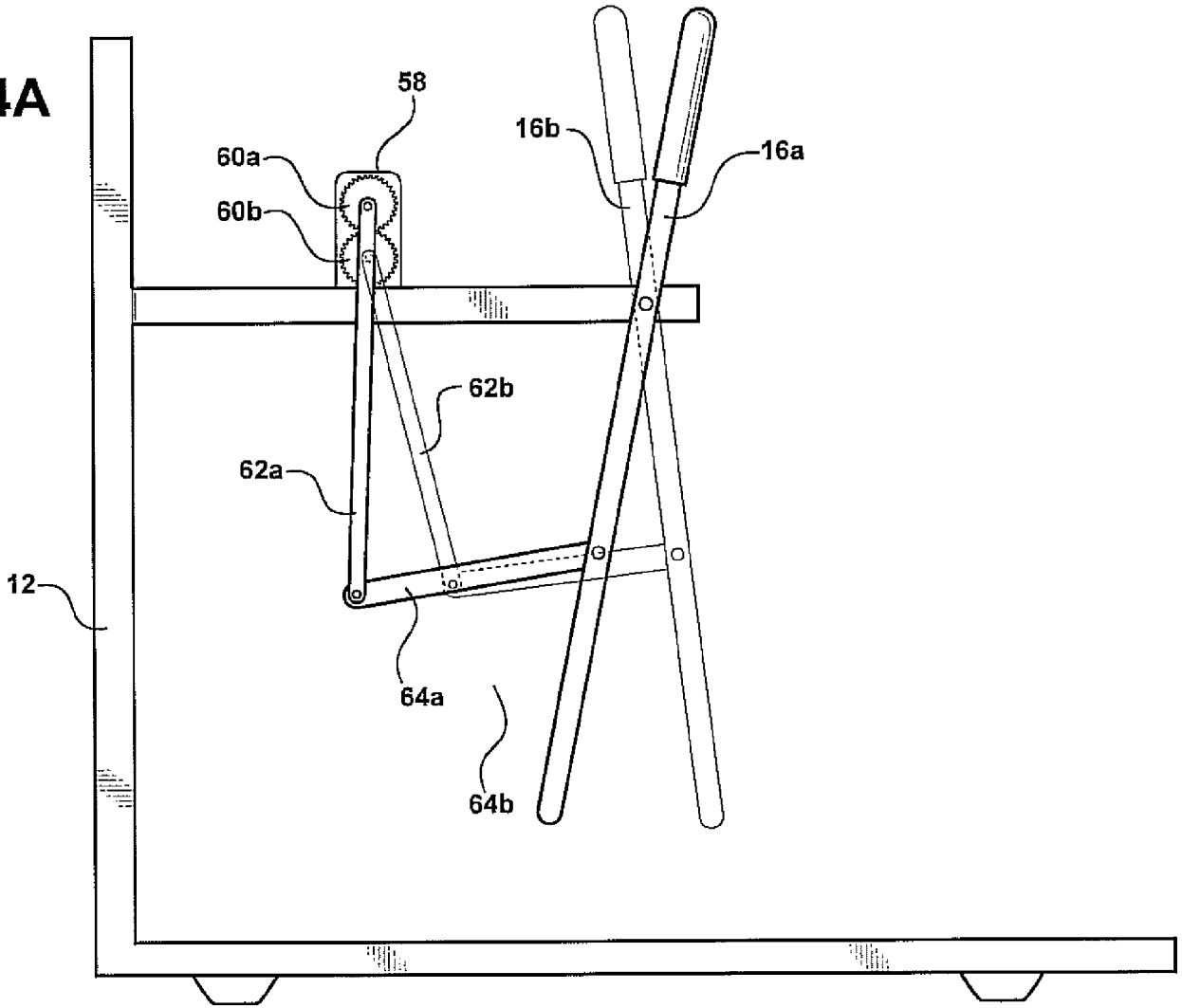
FIGS. 4A and 4B are depictions of other embodiments of another synchronizing mechanism which may be utilized to coordinate the motions of the reciprocal links in the present invention.
Figure 4B:
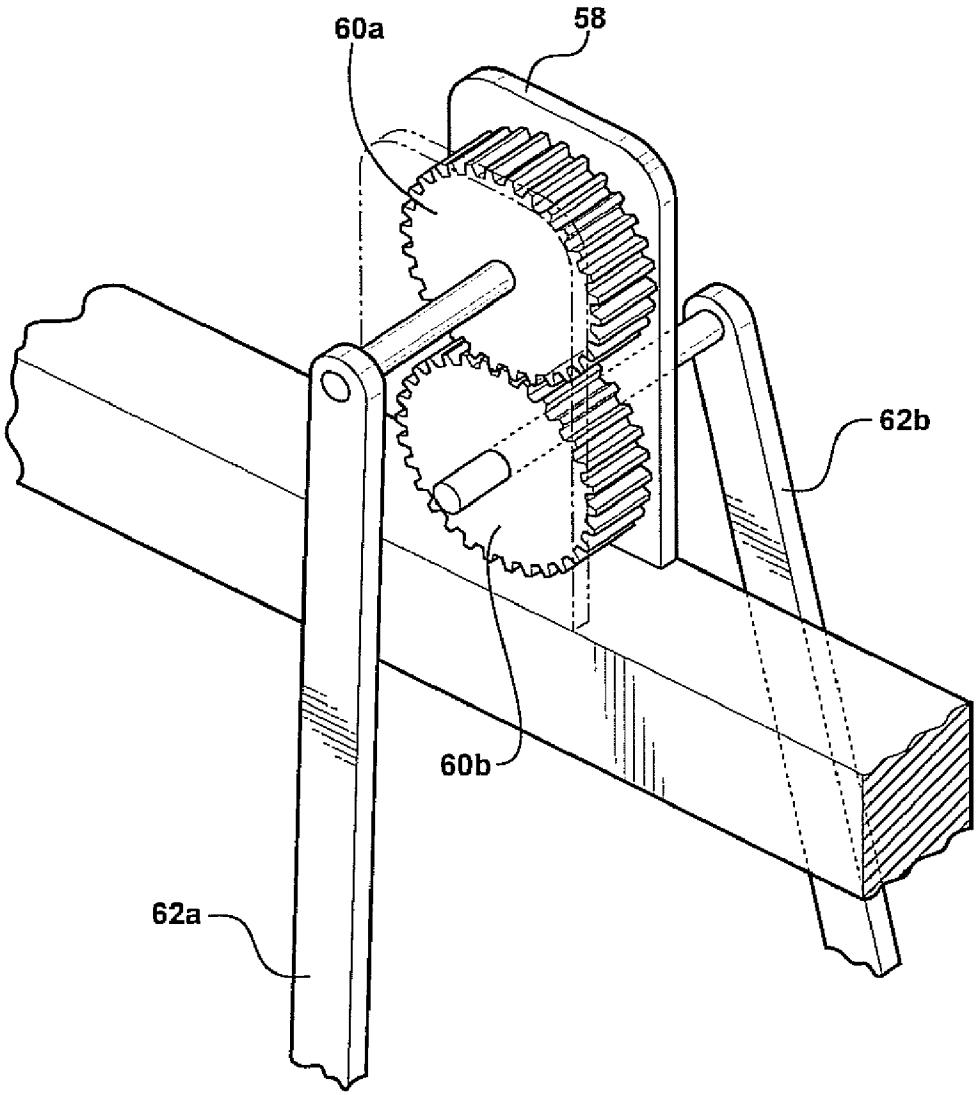

FIGS. 4A and 4B show yet other gearing arrangements for achieving synchronous motion of the reciprocating links. FIG. 4A is a side elevational view of a portion of an exercise device generally similar to those previously discussed, having yet another gearing arrangement for providing coordinated motion of reciprocating links 16*a*, 16*b*. As shown, the system includes a gearbox 58 having a first gear 60*a* and a second gear 60*b* disposed therein. Each gear is in communication with a respective reciprocating link 16*a*, 16*b* by a connector assembly which in this instance includes links 62 and 64. It is to be understood that other connector assemblies may likewise be employed. It is further understood that for purposes of illustration, the FIG. 4A drawing does not include previously described elements of the various embodiments of the invention, such as foot links, control links and associated components.

Referring now to FIG. 48, there is shown a close-up view of the gearbox 58 showing the gears 60*a*, 60*b* and the links 62*a*, 62*b*. It will be appreciated from the figure that use of this gearing arrangement allows for coordinated and opposite motion of the two reciprocating links. As discussed above, resistance devices, as well as other further mechanical and electromechanical elements, may be incorporated into the apparatus, and in some instances, such may be done via the gearing arrangements as shown in FIGS. 3A, 3B, 4A and 4B.

Figure 5:
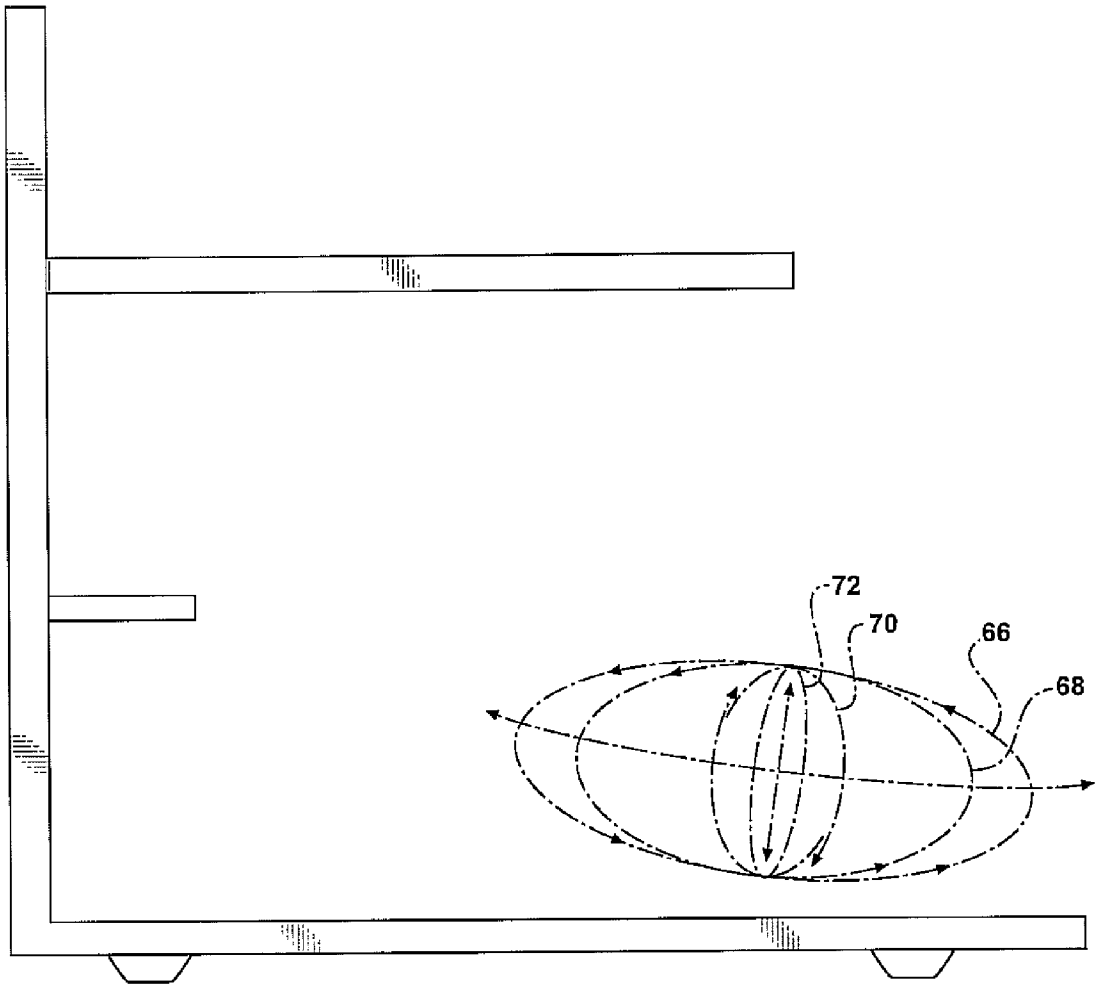
FIG. 5 is a depiction of a portion of an exercise device of FIG. 1 illustrating a range of foot motions which may be achieved thereby.

Referring now to FIG. 5, there is shown a simplified depiction of an exercise device generally similar to that illustrated in FIG. 1; however, for purposes of illustration, only one set of the paired members is shown. As discussed above, the devices of the present invention effectively decouple the back-and-forth foot action ("horizontal") achieved by the reciprocating link from the up-and-down ("vertical") action achieved through the control link operating in connection with the crank arm. In this manner, a wide range of foot actions may be achieved as is illustrated by the series of paths illustrated in FIG. 5. It is a notable feature of a true elliptical exercise device that a very natural foot action is achieved therein wherein, in many instances, as the foot initially begins to travel forward, the heel thereof rises faster than does the toe. Conversely, when the foot initially begins to travel rearward, the heel falls faster than does the toe. The apparatus of the present invention is capable of achieving this type of ideal elliptical action over a very wide range of motions as is shown by illustrated paths 66 and 68. The device in accord with the present invention is also capable of achieving other types of elliptical and non-elliptical foot paths, defining various closed curves as is shown by paths 70 and 72. In addition, the apparatus may be utilized so as to achieve a non-elliptical, non-closed path of travel such as a generally linear path. It will be understood that by appropriately blending these various paths, a thorough workout, exercising a number of muscles is achieved.

The foregoing constitutes a description of some embodiments and implementations of the present invention. It is to be understood that yet other modifications and variations thereof will be apparent to those of skill in the art in view of the teaching presented herein. The foregoing are thus to be understood not to be illustrations of some specific embodiments of the invention and not limitations upon the practice thereof. It is the following claims, including all equivalents, which define the scope of the invention.

The invention claimed is:

1. An exercise device comprising:

a frame having a first, a second and a third pivot point defined thereupon, said pivot points being spaced from one another;

a crank assembly including a first crank arm, said crank assembly being pivotally supported on said frame at said first pivot point so that said first crank arm is rotatable thereabout;

a first and a second reciprocating link each being pivotally supported on said frame at said second pivot point so that a first end of the reciprocating links can move in a first reciprocal path relative to said frame, said first and second reciprocating links being coupled together so that the reciprocal path of travel of said first reciprocating link is equal and opposite to the reciprocal path of travel of said second reciprocating link;

a first and a second foot link, each being in mechanical communication with a respective reciprocating link through a pivot point on said foot link which is spaced from either end of said foot link;

a first and a second swing arm, each being pivotally supported on said frame at said third pivot point so that a first end of each swing arm can move in a second reciprocal path relative to said frame, said swing arms being in mechanical communication with said crank assembly so that when said first crank arm rotates about said first pivot axis, said crank assembly causes said first ends of said swing arms to move in said second reciprocal path;

a first and a second control link, each control link being connected to a respective foot link and to a respective swing arm so that when the first end of each of said swing arms travels in said second reciprocal path, its respective control link moves in a reciprocating path of travel and thereby raises and lowers a portion of the foot link;

wherein in the use of said device, the connection point at which each swing arm is connected to its respective control link travels along a path from a first limit to a second limit; and wherein as each reciprocating link moves in said first reciprocal path of travel, the end thereof defines an angle, relative to the point at which said reciprocating link is pivotally supported on said frame; and wherein said apparatus is configured so that a line extending between said first and second limits is parallel to the bisector of said angle.

2. The exercise device of claim 1, wherein each foot link is directly coupled to its respective reciprocating link.

3. The exercise device of claim 1 wherein the crank assembly includes a flywheel.

4. The exercise device of claim 3, wherein at least a portion of the length of said first crank arm is defined by a portion of said flywheel.

5. The exercise device of claim 1, wherein each of said reciprocating links has a handgrip portion projecting therefrom.

6. An exercise device comprising:

a frame;

a crank assembly including at least a first crank arm pivotally supported on said frame so as to be rotatable;

a first and a second reciprocating link each pivotally supported on said frame so that a first end thereof can move in a reciprocal path of travel relative to said frame, said first and second reciprocating links being coupled together so that the reciprocal path of travel of said first reciprocating link is equal and opposite to the reciprocal path of travel of said second reciprocating link;

a first and a second foot link, each being in mechanical communication with a respective reciprocating link through a pivot point on said foot link which is spaced from either end of said foot link;

a first and a second control link, each control link being connected to a respective foot link, each control link being in mechanical communication with the crank assembly through a coupling assembly which includes a first and a second swing arm, each of which is pivotally supported on said frame and pivotally connected to a respective control link through a respective pivot point, and a first and a second connecting link, each of which is connected to the crank assembly and to a respective swing arm through a respective connection point so that rotation of each crank arm raises and lowers its respective swing arm so that when the respective crank arm rotates, the control link moves in a reciprocating path of travel and thereby raises and lowers a portion of the foot link;

whereby the reciprocating links provide for motion of the foot links along a first path of travel having a significant horizontal component and the control links provide for motion of the foot links along a second path of travel having a large, generally vertical component, wherein the motion of the reciprocating links and the motion of the control links are at least in part mechanically independent of one another so that the ratio of the vertical and horizontal components may be varied during the use of the device.

7. An exercise device comprising:

a frame having a first, a second and a third pivot point defined thereupon, said pivot points being spaced from one another;

a crank assembly including a first crank arm, said crank assembly being pivotally supported on said frame at said first pivot point so that said first crank arm is rotatable thereabout;

a first and a second reciprocating link each being pivotally supported on said frame at said second pivot point so that a first end thereof can move in a first reciprocal path relative to said frame, said first and second reciprocating links being coupled together so that the reciprocal path of travel of said first reciprocating link is equal and opposite to the reciprocal path of travel of said second reciprocating link;

a first and a second foot link, each being in mechanical communication with a respective reciprocating link through a pivot point on said foot link which is spaced from either end of said foot link;

a first and a second swing arm, each being pivotally supported on said frame at said third pivot point so that a first end of each swing arm can move in a second reciprocal path relative to said frame, said swing arms being in mechanical communication with said crank assembly so that when said first crank arm rotates about said first pivot axis, said crank assembly causes said first ends of said swing arms to move in said second reciprocal path;

a first and a second control link, each control link being connected to a respective foot link and to a respective swing arm so that when the first end of each of said swing arms travels in said second reciprocal path, its respective control link moves in a reciprocating path of travel and thereby raises and lowers a portion of the foot link;

whereby the reciprocating links provide for motion of the foot links along a first path of travel having a significant horizontal component, and the control links provide for motion of the foot links along a second path of travel having a large, generally vertical component, wherein the motion of the reciprocating links and the motion of the control links are at least in part mechanically independent of one another so that the ratio of the vertical and horizontal components may be varied during the use of the device.

* * * * *